United States Patent [19]

Brown

[11] 4,049,055

[45] Sept. 20, 1977

[54] GRAVEL PACK METHOD, RETRIEVABLE WELL PACKER AND GRAVEL PACK APPARATUS

[75] Inventor: Joe R. Brown, Houston, Tex.

[73] Assignee: Brown Oil Tools, Inc., Houston, Tex.

[21] Appl. No.: 139,006

[22] Filed: Apr. 30, 1971

[51] Int. Cl.[2] ..... E21B 23/04; E21B 23/06; E21B 33/129; E21B 43/04

[52] U.S. Cl. ..... 166/278; 166/51; 166/120; 166/123; 166/131; 166/212; 166/217

[58] Field of Search ..... 166/120, 122, 123, 126, 166/138, 142, 212, 216, 217, 278, 51, 290, 143, 224 A

[56] References Cited

U.S. PATENT DOCUMENTS

| | | | |
|---|---|---|---|
| 2,677,428 | 5/1954 | Clark | 166/278 |
| 2,942,664 | 6/1960 | Burns | 166/51 |
| 3,072,204 | 1/1963 | Brown | 166/120 |
| 3,126,963 | 3/1964 | Graham | 166/51 |
| 3,392,784 | 7/1968 | Brown | 166/123 |
| 3,627,046 | 12/1971 | Miller et al. | 166/278 |
| 3,710,862 | 1/1973 | Young et al. | 166/278 |

OTHER PUBLICATIONS

Uren, Petroleum Production Engineering, 1956, pp. 720–721.

*Primary Examiner*—Stephen J. Novosad
*Attorney, Agent, or Firm*—Carlos A. Torres; E. Richard Zamecki

[57] ABSTRACT

The assembly is supported and operated by a tubing string and includes an hydraulically set packer carrying a production screen and a removable gravel pack apparatus. The packer is set, gravel is packed about the screen and the gravel pack apparatus is then removed from the set packer by disengaging a pin and slot connection. The gravel pack apparatus and attached screen may be subsequently re-engaged with the packer for regraveling. The packer is equipped with resilient seal means and a plurality of radially movable anchoring slips which are set in sealing and anchoring engagement, respectively, with a surrounding well conduit by an hydraulic setting mechanism. The gravel pack apparatus cooperates with the set packer to form a series of separate, axially extending, flow passages which may be selectively opened or closed.

43 Claims, 23 Drawing Figures

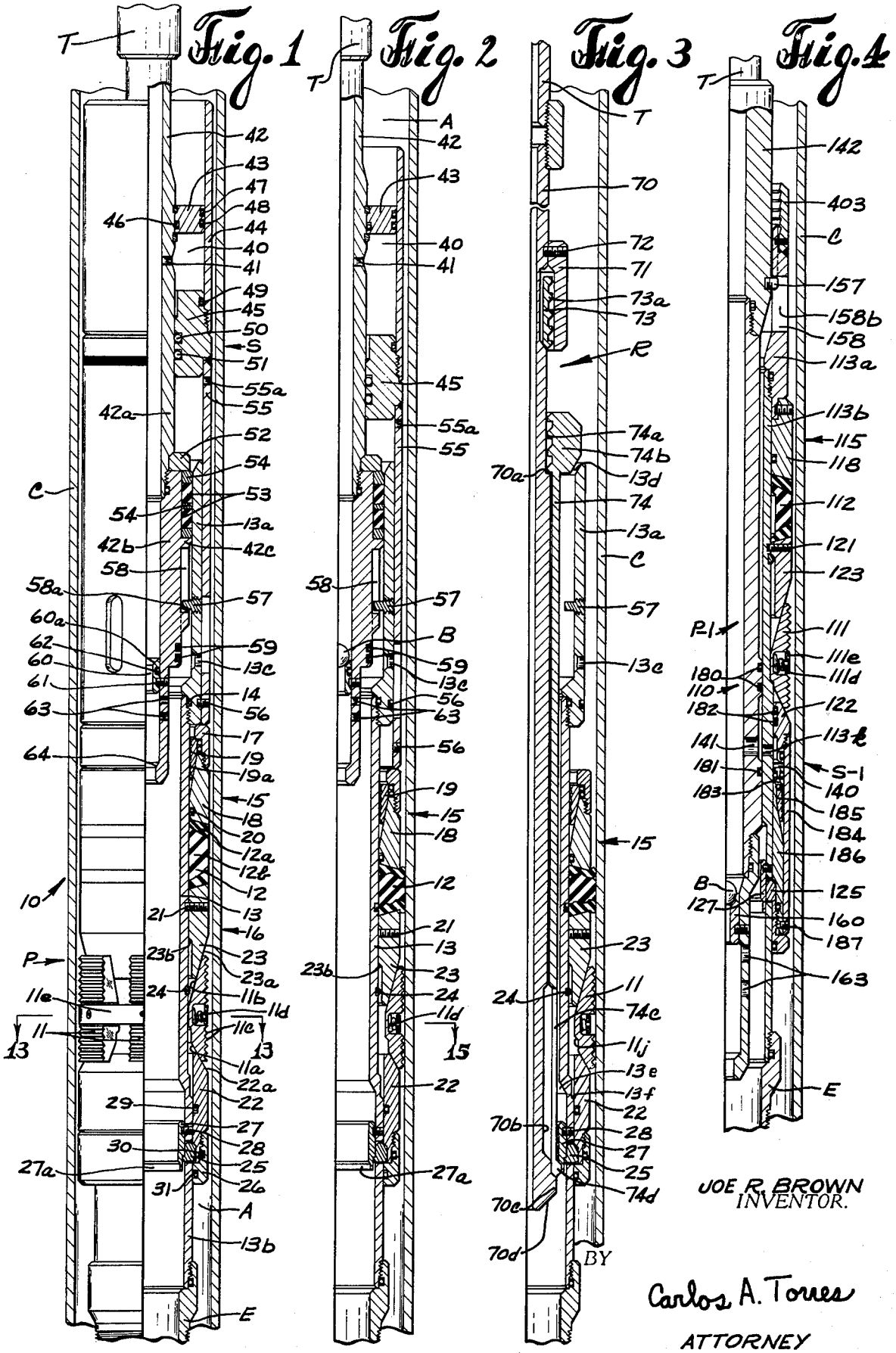
JOE R. BROWN
INVENTOR.
BY
Carlos A. Torres
ATTORNEY

JOE R. BROWN
INVENTOR.

BY

Carlos A. Torres

ATTORNEY

JOE R. BROWN
INVENTOR.

BY Carlos A. Torres

ATTORNEY

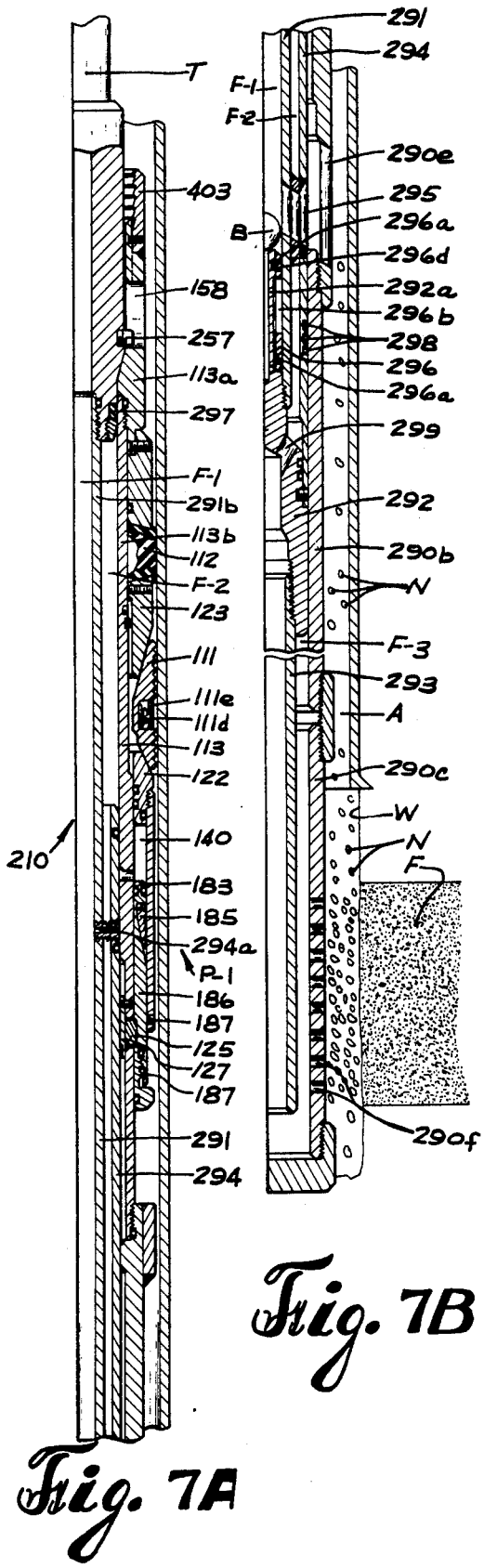
Fig. 7A
Fig. 7B
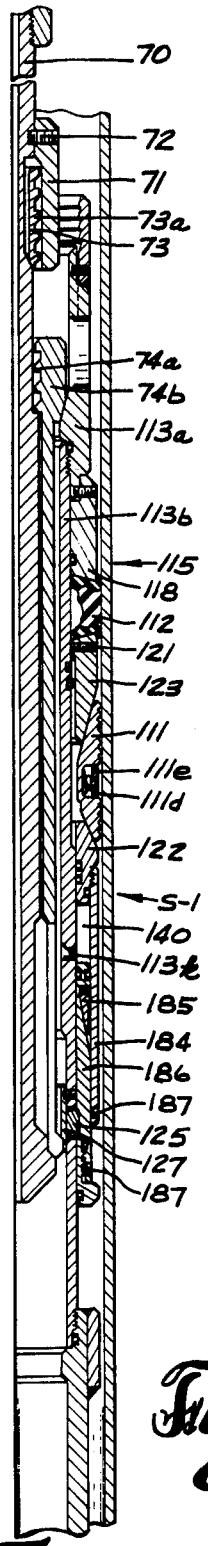
Fig. 8
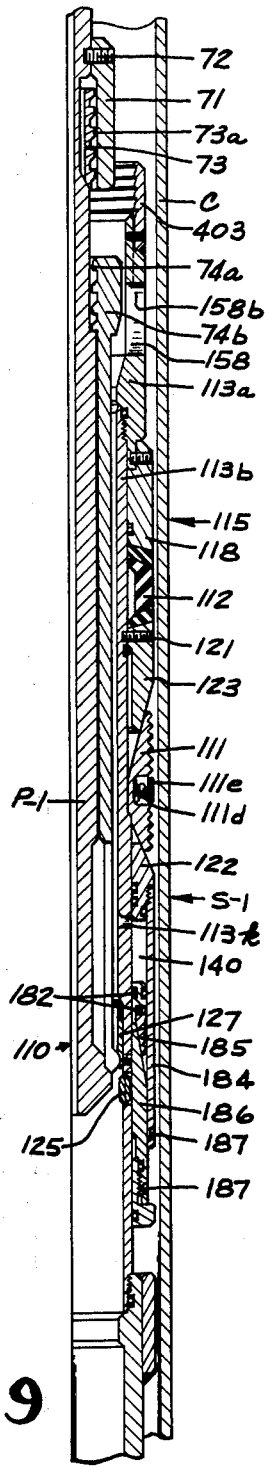
Fig. 9
JOE R. BROWN
INVENTOR.
BY Carlos A. Torres
ATTORNEY

JOE R. BROWN
INVENTOR.

BY

Carlos A. Torres

ATTORNEY

JOE R. BROWN
INVENTOR.

BY Carlos A. Torres

ATTORNEY

JOE R. BROWN
INVENTOR.

BY Carlos A. Torres

ATTORNEY

GRAVEL PACK METHOD, RETRIEVABLE WELL PACKER AND GRAVEL PACK APPARATUS

BACKGROUND OF THE INVENTION

1. Field of the Invention

The present invention relates to apparatus designed to be employed in the construction or operation of oil and gas wells. More specifically, the present invention relates to a new and improved hydraulically set, retrievable packer and removable gravel pack apparatus designed to be run as a unit in an oil or gas well. The gravel pack and packer are employed to position gravel or other filtering material in the annular space between a screen carried by the packer and the walls of the surrounding well bore. The gravel acts to support the unconsolidated formation surrounding the well bore and simultaneously filters out fine sand and other solid particles so that relatively clean fluids enter the production tubing through the screen.

2. Description of the Prior Art

It is conventional in prior art practice to employ permanent packers which after being set in the well bore may be removed only by milling or other techniques which effectively destroy the packer for subsequent use. Such permanent packers are desirable to the extent that they are capable of providing relatively large axial openings because of their slimline construction and are also able to provide a reliable seal against pressure exerted from either above or below the packer seal. However, to the extent that milling and other means required to remove permanent packers are time consuming and expensive and prevent further use of the packer, such packers are objectionable.

Retrievable packers commonly found in the prior art overcome certain of the problems associated with permanent packers but are objectionable in that the release mechanisms employed often require a reduction in the central opening extending through the packer. Moreover, retrievable packers often do not function as well in providing a positive pressure seal against pressure exerted from both above and below the packer seal, and are difficult to release once having been set. Releasable packers requiring extensive rotational movements to effect either release of a tubing string or release of the packer's setting mechanism and undesirable in that the large torsional forces developed may cause damage and injury if suddenly released through inadvertence or structural failure.

A common problem often found with retrievable anchoring mechanisms set in a well conduit stems from the difficulty encountered in separating wedged slips and spreaders following anchoring of the components. In such devices, complete separation of slips and spreaders must be effected before the slips are permitted to retract radially away from anchoring engagement with the surrounding well conduit. Because of the high forces employed to set the anchoring assembly initially, such separation may become extremely difficult to effect.

In gravel pack equipment, retrieval problems are associated with the release means in prior art apparatus designed to be removable from a set packer. Where such release requires disconnection of threads engaged between the gravel pack and packer, undesirably large twisting forces may be required to produce the necessary separation.

Another shortcoming associated with certain prior art gravel pack designs includes their inability to permit pressure testing of the set packer below the packer seal. Conventional gravel packs of the type where the packer carries a packing screen and is set by the pressure supplied through a tubing string also lack suitable provision for removing debris from the internal portion of the screen by circulating fluids without the use of auxiliary equipment employed after the gravel pack is removed from the packer. Many of these shortcomings stem from the limited number of flow passages and the limited controls for regulating flow through passages found in prior art systems.

Because of the need in a retrievable system for axial and rotational movements to effect the desired setting, release, and passage opening and closing in assemblies of the present type, it is necessary that suitable safety latching and locking provisions be included in such assemblies to prevent inadvertent or undesired movements in the assembly. Prior art devices which have employed such locking and latching mechanisms have often required relatively complex and bulky components which in many cases have proved unsatisfactory or unreliable.

One prior art system employs a combined packer and gravel pack apparatus which employs hydraulic pressure to set the anchoring mechanism in the packer and a vertical movement of the tubing string to open a cross-over flow passage. Preferably, however, setting of the anchoring mechanism and opening of the cross-over passage is effected by simply applying hydraulic pressure through the supporting tubing string whereby slips are set and the cross-over is opened by the same hydraulic action. By this means, setting of the packer and opening of the cross-over passages is effected in a single step rather than in the two-step operation of pressuring followed by axial movement of the tubing string. It is also desirable that the setting and subsequent anchoring engagement of the packer be independent of the weight of the tubing string to which the gravel pack apparatus is secured. This is particularly so where the gravel pack apparatus is to be removed from the set packer after the gravel packing operation has been completed.

SUMMARY OF THE INVENTION

The apparatus of the present invention includes an improved packer which may be firmly anchored against forces exerted from above or below the packer. The anchoring means include a plurality of single piece slip elements which are expanded and wedged by upper and lower conical spreaders adapted to move under oppositely tapered upper and lower bearing faces formed on the slip elements. In the preferred form, the lower bearing face on the slip members ranges between 30° and 45° whereas the upper bearing face is approximately 15°.

The packer is adapted to be set by hydraulic pressure and is retrievable by a straight pull on the tubing string which severs connecting shear pins to permit retraction of the slips and seal. The initial portion of the straight pull release retracts the 15° wedge away from the slip members which then tend to move off the relatively steep incline of the lower wedging member under the biasing influence of resilient springs. If the slip members remain wedged on the lower spreader cone, continued upward movement of the string draws an engagement shoulder on a driving means against shoulders on the slips to pull the slips off of the steeper cone spreader to provide a secondary release action which ensures complete retraction of the slips. A major portion of the friction creating teeth on the slips are at the upper slip ends to further assist release by retraction of the upper cone.

The construction of the packer of the present invention provides the advantages of a permanent type packer in a retrievable packer. Specifically, relatively thin walled construction is permitted and the packer remains firmly anchored against pressure or forces applied from either above or below the set packer. Safety provisions are provided so that the packer may be firmly and positively anchored without affecting its ability to be later released and retrieved. Positive straight pull release movements protected with safety locks are employed to eliminate the need for high torsion release forces while simultaneously preventing inadvertent release of the packer from set position.

The slips of the packer of the present invention are mounted about the packer by an annular mounting body rather than the conventional slip cage which reduces construction costs and weight of the packer. Radial slots formed in the mounting body confine slip movement and helical springs positioned between the slips and the body retain the slips in a normally retracted position.

In the preferred form of the packer, the setting mechanism is retrievable from the set packer and may be reused to reduce overall costs and to reduce the amount of equipment remaining in the well.

The gravel pack portion of the present invention employs a series of longitudinal flow passages extending above and below the set packer seal. The passages may be separately opened or closed to permit either testing below the set packer or washing out of the screen as well as to permit conventional gravel pack operations. The gravel pack apparatus is releasably secured within the packer by a cooperating pin and slot arrangement. Setting of the slips in the packer and opening of a crossover passage in the gravel pack apparatus are effected by simply applying hydraulic pressure through the tubing string. No mechanical movement of the string is required to open the crossover passage. Anchoring of the packer and operation of the gravel pack apparatus are independent and the packer remains firmly anchored whether the gravel pack apparatus is in position or not.

The gravel pack apparatus of the present invention includes three separate flow passages, two of which may be opened and closed by vertical movement of the tubing string. This increases the flexibility of the apparatus and permits the internal portion of the screen to be cleansed of debris by circulated fluids and also permits testing of the packer seal from below the packer before the gravel pack apparatus is removed. The gravel pack apparatus may be reattached to the set packer and removed therefrom as many times as desired to permit regraveling or other operations. These and other features and advantages of the present invention will be more fully appreciated from the following specification, the related drawings and claims.

BRIEF DESCRIPTION OF THE DRAWINGS

FIG. 1 is a vertical elevation in quarter section illustrating the packer portion of the present invention in unset position;

FIG. 2 is a quarter-sectional elevation of the packer of FIG. 1 illustrating the slips and seal of the packer set against the walls of the surrounding conduit;

FIG. 3 is a quarter-sectional elevation illustrating a retrieving head engaging the set packer preparatory to releasing the packer from the surrounding well conduit;

FIG. 4 is a quarter-sectional elevation illustrating a modified form of the packer portion of the present invention in which the setting means is integrally formed with the packer;

FIGS. 7A and 7B are quarter-sectional elevations of the apparatus of FIGS. 5A and 5B testing below the set packer;

FIG. 8 is a quarter-sectional elevation illustrating a retrieving head attached to the packer of FIGS. 5A and 5B preparatory to releasing the packer from the surrounding well conduit;

FIG. 9 is a quarter-sectional elevation of the packer of FIG. 8 in released position being removed from the well conduit;

DESCRIPTION OF THE PREFERRED EMBODIMENTS

The preferred form of the packer portion of the present invention is indicated generally at 10 in FIG. 1. The packer is illustrated in position within a tubular well conduit C where it is supported and subsequently set by a tubing string T which extends to the well's surface. Any desired equipment E may be secured to the packer 10 which, when set, functions to anchor the equipment E within the well conduit and to form a pressure tight seal in the annulus A between the packer body and the conduit C.

The packer 10 includes a packer portion P which is equipped with metal anchoring slips 11 and a resilient pressure seal 12. When the packer is set, the slips 11 are expanded radially outwardly into anchoring engagement with the conduit C and the seal 12 is expanded radially outwardly into anchoring engagement with the conduit C to form an anchored, pressure tight seal between the packer and the conduit. Inserts 12*a* of relatively hard material are carried at the upper and lower ends of the seal 12 to reduce cold flow of a softer resilient material 12*b* employed in the center of the seal 12.

Figure 10:
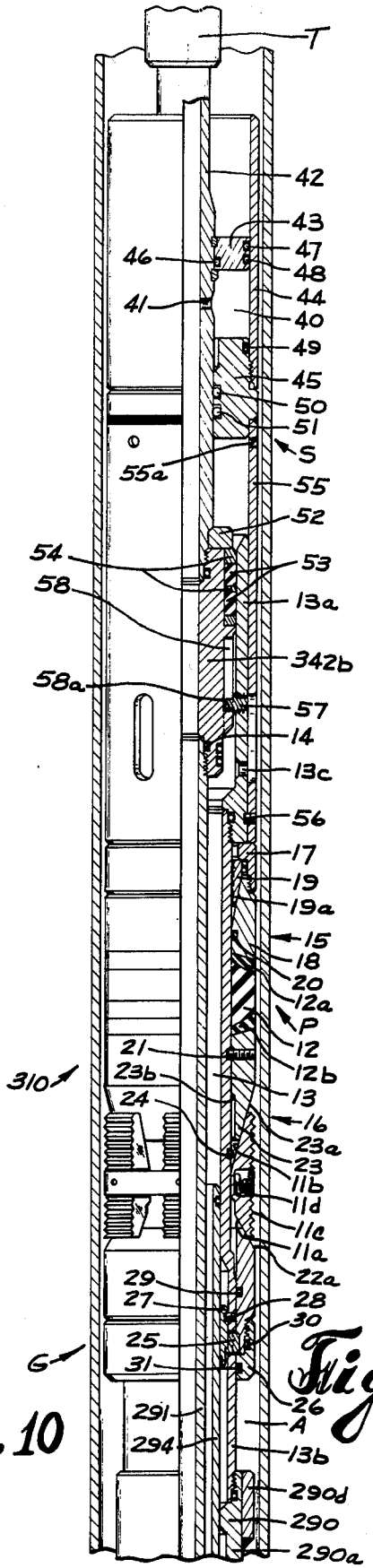
FIG. 10 is an elevation in quarter-section illustrating a modified form of the present invention employing a gravel pack apparatus carried in a packer such as illustrated in FIG. 1 with the packer components in unset condition.
Figure 11:
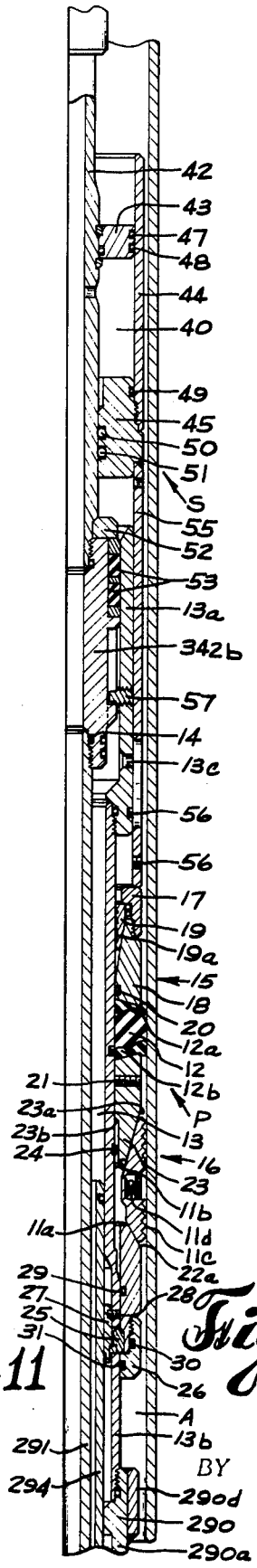
FIG. 11 is a quarter-sectional elevation illustrating the packer of FIG. 10 in set condition.
Figure 12:
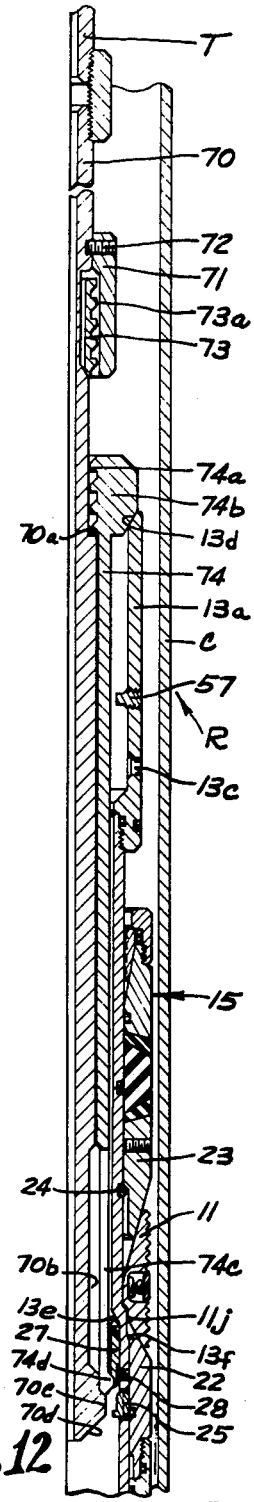
FIG. 12 is a quarter-sectional elevation illustrating a retrieving head in engagement with the packer showing the packer of FIG. 10 in released condition.

The packer 10 is set with a removable, hydraulically actuated setting portion indicated generally at S which expands the slips 11 and seal 12 to provide the desired anchor and seal. In the description of the packer 10 to follow, reference will be made to FIGS. 1, 2, 3, 10, 11 and 12 which illustrate the packer portion P either by itself as illustrated in FIGS. 1–3 or in combination with a gravel pack apparatus as illustrated in FIGS. 10–12. It will be understood that in each of these figures, the packer portion P is constructed and operated in the same manner. FIGS. 2 and 3 illustrate the slips 11 and seal 12 of the packer portion P in set position and FIG. 3 illustrates the packer portion as it appears with the setting portion S removed. In the assembly of FIG. 3, the setting portion S has been replaced by a retrieving mechanism R employed to release the packer from its set condition and the assembly is illustrated as it appears before release of the packer.

With initial reference to FIGS. 1, 2 and 3, the packer portion P may be seen to include a supporting outer body or mandrel 13 upon which the slips 11 and seal 12 are mounted. The packer mandrel 13 is substantially tubular and is of composite construction having a top portion 13*a* threadedly engaged with a bottom portion 13*b.* A suitable resilient O-ring seal 14 is carried between the two mating supporting body portions to provide a leakproof connection. The primary packer seal 12 is mounted to be compressed between axially movable, upper and lower bearing assemblies, 15 and 16, respectively, which in turn are mounted for axial movement over the mandrel 13. The upper bearing assembly includes a retaining collar 17 threadedly engaged with a bearing member 18. A split annular locking ring 19 is confined between the collar 17 and bearing member 18. A plurality of axially spaced, upwardly directed, circumferentially extending teeth 19*a* are formed along the internal surface of the ring 19 while the external ring surface is substantially conical and tapers downwardly to form a bearing surface which is adapted to slide against an outwardly opening conical bearing surface formed internally of the bearing member 18. The upwardly directed teeth 19*a* and tapered bearing surfaces acting between the ring 19 and bearing member 18 permit the mandrel 13 to be moved upwardly relative to the assembly 15 and prevent the reverse relative movement between the two components. An annular O-ring seal 20 carried between the bearing member 18 and the mandrel portion 13*b* cooperates with the primary seal 12 to provide a complete seal of the annular area A when the packer P is set.

The lower bearing assembly 16 is initially secured to the lower mandrel portion 13*b* by a severable shear pin 21. When the pin 21 is intact as illustrated in FIG. 1, the upper assembly 15 is at its upper axial position against the base of upper mandrel section 13*a* and the seal 12 is in its relaxed, radially retracted position as required when the device is initially lowered into the well conduit C.

A lower, conical spreader 22 cooperates with an upper conical spreader 23 in the bearing assembly 16 to form first and second wedging means, respectively, which are adapted to be moved toward each other during the setting procedure to cause the slip members 11 to be moved radially outwardly into anchoring engagement with the well conduit C. In accordance with one of the important features of the present invention, the lower bearing member 22 includes a relatively steeply inclined bearing face 22*a* which is adapted to connect and bear against correspondingly inclined internal bearing faces 11*a* formed behind each of the plural, single piece slip members 11. The bearing faces 22*a* have an effective angle of inclination with respect to the vertical of approximately 45°, but, if desired, may be inclined between approximately 30°–45°. The upper wedging means 23 is equipped with a conical spreading surface 23*a* which is adapted to connect and bear against similarly inclined bearing surfaces 11*b* formed along the upper internal surfaces of the slip members 11. The effective angle of inclination of the bearing faces 11*b* is preferably approximately 15° with the vertical.

Figure 13:
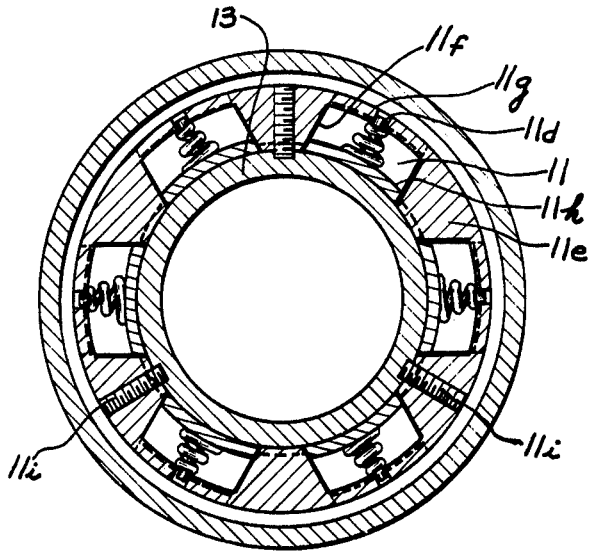
FIG. 13 is an enlarged cross-sectional view taken along the line 13—13 of FIG. 1.
Figure 15:
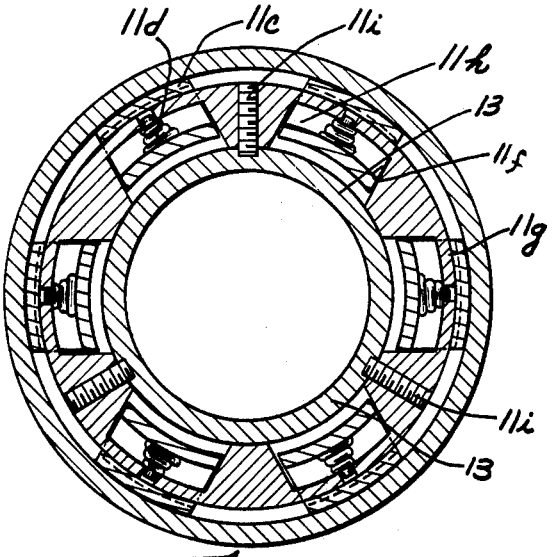
FIG. 15 is an enlarged cross-sectional view taken along the line 15—15 of FIG. 2.

The slips 11 are formed by a plurality of single piece elements which are equipped with circumferentially extending, axially spaced teeth 11*c* adapted to engage and frictionally lock with the surrounding well conduit C when the packer P is set. A major portion of the friction producing teeth in each of the slips 12 is positioned at the upper slip location for a purpose to be described. Under normal unset conditions, the slips 11 are held in a radially retracted position under the influence of biasing springs 11*d* acting between the slip members 11 and an annular mounting body 11*e* which crosses the center of the slips and maintains them in position about the packer mandrel 13. As best seen in FIGS. 13 and 15, the mounting body 11*e* includes a plurality of radially extending slots 11*f* which direct and confine the movement of slips 11. Annular retaining band portions 11*g* limit the outward travel of the slips 11. The band-portions fit in lateral slots 11*h* formed across the center of the slips to permit the friction producing teeth 11*c* to move radially beyond the band portions 11*g* to engage the walls of conduit C. The body 11*e* is fixed to the packer mandrel by suitable pins 11*i.*

Figure 16:
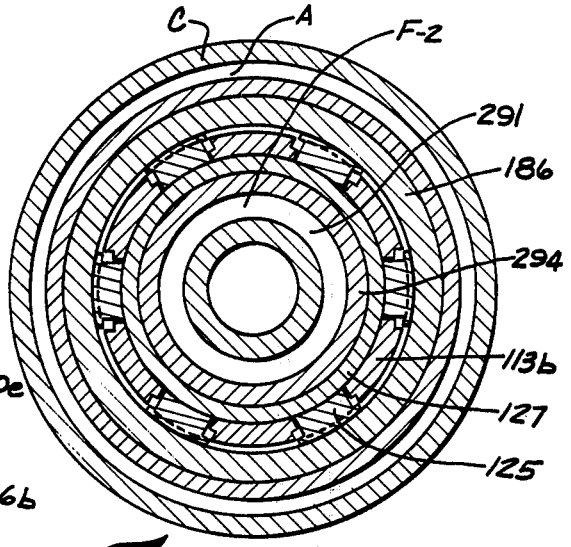
FIG. 16 is an enlarged cross-sectional view taken along the line 16—16 of FIG. 6B.

Downward movement of the lower bearing assembly 16 relative to the lower mandrel portion 13*b* is limited by a split ring 24 set within a circumferentially extending mandrel recess. During the retrieval operation, the ring 24 engages an internal shoulder 23*b* formed in the assembly 16 to prevent resetting of the slips. When the packer is set, the lower spreader 22 is locked against axial movement over the mandrel 13 by its engagement with dogs 25 which prevents release of the set packer. The configuration of the dogs 25 may be better understood by reference to FIG. 16 which illustrates corresponding dogs employed in a modified form of the invention. As seen in FIGS. 1–3, the lower end of bearing member 22 is threadedly engaged to a lower retaining collar 26 to form a radial recess within which the dogs 25 are received. Radial retraction of the dogs 25 from the recess is prevented by the process of an annular collar 27 which is temporarily held in position by a severable shear pin 28. As will be seen, a retrieving means is adapted to engage the sleeve 27 and pull it upwardly to sever the pin 28 thereby permitting the dogs 25 to retract radially. This in turn permits relative axial movement between the member 22 and the mandrel 13 as required to release the packer P from set position. Suitable O-ring seals 29, 30 and 31 carried by the lower wedging assembly provided a leakproof seal around the openings formed to receive the radially movable dogs 25 to prevent leakage from the internal bore of the packer.

The setting mechanism of the present invention as illustrated in FIGS. 1, 2, 10 and 11 includes an hydraulically expandable annular chamber 40 which is supplied with fluid pressure through a radial bore 41 formed in a central tubular setting mandrel 42 which provides an upper attachment to the tubing string T. An annular member 43 is secured to the setting mandrel 42 to form the upper chamber end. The member 43 is fixed on the mandrel 42 and forms a sliding seal with a tubular sleeve 44 which provides the outer chamber wall. The lower axial end of chamber 40 is provided by a second annular member 45 which is fixed with respect to the sleeve 44 and is adapted to slide along the internal chamber wall provided by the mandrel 42. Fixed annular O-ring seals 46 and slidable annular O-ring seals 47 and 48 in the upper annular member 43 cooperate with a fixed O-ring seal 49 and slidable O-ring seals 50 and 51 in the lower annular member 45 to form an expandable, pressure tight chamber. As will be seen, the chamber 40 increases in size as the two members 43 and 45 are moved axially away from each other under the influence of hydraulic pressure supplied through the tubing string T.

The setting mandrel 42 is a plural part member which, in the form illustrated in FIGS. 1 and 2, includes an upper tubular section **42*a* threadedly engaged to a lower tubular section 42*b*. In the form of the invention illustrated in FIGS. 10 and 11, a modified assembly to be hereinafter described is substituted for the section 42*b*. A retaining collar 52 is secured in a recess formed by the threaded engagement of members 42*a* and 42*b* to hold a plurality of annular rubber seals 53 and annular metal spacers 54 in position against a radially extending shoulder 42*c* formed on the mandrel section 42*b*. The seals 53 form a sliding, pressure tight seal between the mandrel section 42*b* and the internal cylindrical wall of the packer mandrel member 13*a*** for a purpose to be hereafter described.

A depending sleeve 55 is secured to the base of annular member 45 and telescopes over mandrel member **13*a* to which it is releasably secured at its lower end by a severable shear pin 56. During the initial positioning of the packer 10 within the well conduit C, the setting mechanism S and packer P are prevented from relative movement with respect to each other by shear pin 56. Following severance of the shear pin 56, limited axial movement between the two components is permitted by a predetermined sequence of rotational and axial movements which permit pins 57 projecting internally of the upper supporting body portion 30*a* to be moved through slotted pathways 58 formed on the external surface of the setting mandrel section 42*b*. While only a single pin 57 and slotted pathway 58 are illustrated in FIGS. 1 and 2, it will be understood that two or more cooperating pathways and pins may be disposed circumferentially around the two mandrels. As will be seen, axial movement of the mandrel 42 permits O-rings 59 carried on member 42*b* to be moved into sealing engagement with the internal wall of packer mandrel section 13*b*** to seal off an annular flow passage through the packer.

An internal setting collar 60 is temporarily secured within the bore of mandrel section **42*b* by a severable shear pin 61. A resilient annular seal 62 is positioned between the sleeve 60 and the member 42*b* to provide a leakproof connection between the two components. The lower portion of the setting mandrel 42*b* includes a plurality of radially extending flow passages 63 and the base of mandrel 42*b* is equipped with an inwardly formed retaining shoulder 64 which is adapted to engage the collar 60 after it is released by separation of the shear pin 61.**

The setting operation of the packer 10 will now be described with reference to FIGS. 1 and 2 of the drawings. When the packer 10 has been lowered to the desired subsurface location within the conduit C, a metal ball of brass or other suitable material is dropped through the tubing string T and landed on a seating surface **60*a* formed at the upper end of the setting collar 60. Hydraulic pressure is then supplied through the tubing string T and the ball B cooperates with the seat 60*a* and O-ring 62 to prevent bypass of the hydraulic fluid so that a substantial setting pressure may be developed internally of the tubing string T. This setting pressure which is communicated from the setting mandrel 42 to the expandable chamber 40 through the radial bore 41 induces forces in the chamber 40 tending to drive the upper annular member 43 away from the lower annular member 45. Upward movement of the member 43 is transmitted to the setting mandrel 42 and movement of the lower member 45 is transmitted to the depending sleeve 55. A bore 55*a* provided in the sleeve 55 prevents fluid lock from developing during the expansion of chamber 40 by permitting fluid to flow from the annular area between mandrel portion 42*a* and sleeve 55. The developed setting force and resultant movement ultimately sever shear pin 56 which permits the sleeve 55 to move downwardly with respect to the packer mandrel 13. The lower end of the sleeve 55 engages the upper end of bearing assembly 15 causing it to also move downwardly. During the expansion of chamber 40, it will be appreciated that the packer mandrel 13 is prevented from moving with respect to the setting mandrel 42 because of engagement of the pins 57 with base portions 58*a* of slots 58. Continued downward movement of the bearing assembly 15 over the mandrel 13 compresses the seal 12 to expand it radially into firm sealing engagement with the surrounding well conduit C. When sufficient downwardly directed forces are developed in the seal 12, the shear pin 21 is severed which permits the upper spreader 23 to move downwardly toward the lower spreader 22 to move the anchoring slips 11 radially outwardly against the biasing force of the springs 11*d* as illustrated in FIG. 2. When the anchoring slips 11 are firmly set, the setting pressure may be released. At this point, the compressed packer 12 tends to urge the upper bearing assembly 15 upwardly causing the teeth 19*a* in the lock ring 19 to dig into the supporting packer mandrel 13. The upwardly directed force acting against the tapered internal bearing surface of bearing member 18 forces the locking ring 19 into firm locking engagement with the mandrel 13** to prevent the packer from being released.

The setting pressure is maintained and increased even after setting of the packer P to force pin 61 to sever. This permits the sleeve 60 to be moved downwardly against the retaining shoulder 64 to open ports 63 for fluid flow from the center of setting mandrel 42. With the setting mechanism S and packer P in the position illustrated in FIG. 2, fluid circulated from the wellhead through the annular area A above the set packer 12 flows down the annulus and through ports **13*c* extending through the upper mandrel portion 13*a*. From this point, the fluid may flow downwardly between the mandrel 13 and the lower end of setting mandrel 42 and up through the bore of mandrel 42. Reverse flow is also permitted for fluid introduced from the tubing string T. This flow path may be closed by lowering the tubing string T to bring the O-rings 59 into engagement with the internal walls of packer mandrel section 13***b*. Such movement is permitted by an axially extending pathway in slots 58 whereby the pins 57 may move substantially to or near the top of the slots. With this latter flow passage closed, fluids introduced through the tubing string are prevented from returning through the annulus A and the set packer seal 12 may thus be tested for leakage by pressure introduced below the seal.

The packer has been properly set, the setting mechanism S and attached tubing string T may be removed from the well conduit C leaving the packer portion P set in position. Removal is effected by manipulating the tubing string T until the pins 57 align with downwardly directed slot paths in slots 58 which permits complete removal of the pins from the slots. Subsequent upward movement of the tubing string T then releases the setting mechanism S from the pins 57 and the entire setting mechanism S may be pulled free of the set packer P. Although not specifically illustrated, it will be understood that the slot arrangements 58 include a series of interconnected laterally and circumferentially extending grooves formed on the mandrel member 42*b* and that such grooves cooperate with pins 57 whereby relative movement is prevented or permitted depending upon the position of the pins 57 in the slots 58 and whereby the pins may be completely withdrawn from the slots to permit complete separation of the setting mandrel 42 and the packer mandrel 13. By this means, the pins 57 and slots 58 function to provide a releasable latching means between the tubing string and the packer.

With reference to FIGS. 3 and 12, the retrieval or release operation of the packer portion P will now be described. The tubing T is equipped with a retrieving mechanism indicated generally at R employed to reattach to and release the set packer. The mechanism R includes a central retrieving mandrel 70 about which is secured a protective collar 71 temporarily held against axial movement by severable shear pin 72. The collar 71 covers a radially compressed, resilient split ring 73 equipped with external locking teeth 73*a* and adapted, when exposed by axial movement of the collar 71 to expand radially outwardly and ratchet into engagement with internal teeth 74*a* formed on a supporting collar 74*b* which forms the upper portion of a tubular retrieving body 74. The body 74 is adapted to move axially over the retrieving mandrel 70 between the collar 71 and a restraining shoulder 70*a* during the retrieving operation in a manner to be described hereafter. The lower portion of tubular body 74 is equipped with a plurality of downwardly developed resilient fingers 74*c* equipped at their lower end with enlarged heads 74*d*. The lower end of retrieving mandrel 70 is equipped with an annular surface recess 70*b* and an enlarged restraining head 70*c*.

In the retrieval operation, which will be described by joint references to FIG. 3 and the modified form illustrated in FIG. 12, the retrieving mechanism R is lowered into the well conduit C until it engages the upper end of the packer mandrel 13. The upper end of mandrel portion 13*a* is equipped with an inwardly tapered surface 13*d* which engages a similarly tapered lower surface 70*d* formed on the restraining head 70*c* to center the retrieving mechanism and direct it downwardly into the bore of the packer mandrel 13. During the lowering process, the enlarged heads 74*d* at the base of depending resilient fingers 74*c* are depressed into the recess 70*b* where they are free to move axially below internal restrictions formed within the bore of packer mandrel 13. When the enlarged heads 74*d* have cleared the bottom of the sleeve 27, they are freed to spring radially out of the receiving recess 70*b*. Subsequent upward movement of the tubing string T draws the restraining head 70*c* into engagement with the finger heads 74*d* as illustrated in FIG. 3. When in this position, the enlarged heads 74*d* are prevented from retracting radially inwardly so that when drawn into engagement with a receiving shoulder 27*a* (FIG. 2) formed at the lower end of the sleeve 27, the heads 74*d* function to transmit upwardly directed movement of the restraining mandrel 70 to sleeve 27. When sufficient upwardly directed forces are exerted on sleeve 27, the hear pin 28 severs permitting the sleeve to be drawn axially upwardly above the axial position of the dogs 25 as illustrated in FIG. 12. This in turn frees the dogs 25 permitting them to retract radially which then permits the upward movement of the retrieving mandrel 70 to be transmitted through the enlarged head 74*d* to the collar 27 and against an internal mandrel shoulder 13*e*. This action moves the upper bearing assembly 15 upwardly to permit retraction of the seal 12. Upward movement of the packer mandrel 13 also brings the engaging ring 24 against the spreader shoulder 23*b* causing the wedging member 23 to be pulled out from under the set slips 11. With the upper member 23 extracted, the slips are freed along their upward ends which contain the major portion of the friction producing teeth 11*c* so that the slips may fully retract under the biasing force of springs 11*d*. The relative positions of the various components when the packer is fully released may be seen by reference to FIG. 12. If the slips should remain set and in wedging position over the lower spreader 22, continued upward movement of the retrieving mandrel 70 draws a driving shoulder 13*f* into engagement with an internal slip shoulder 11*j* to pull the slip off of the spreader 22 thereby permitting complete radial retraction of the slips.

The relatively steep bearing face angle between the lower wedging means 22 and the slips 11 facilitates the secondary release procedure of pulling the slips off of the spreader. The effect is enhanced where each of the teeth 11*c* on the slips are formed from two surfaces which meet at approximately 90° with respect to each other since movement along the 45° bearing face surface of the slips permits the teeth surfaces to essentially slide away from engagement with the conduit wall rather than to require that the tips of the teeth be broken away.

It it becomes desirable to release the retrieving means R from the set packer after the enlarged heads 74*d* have been dropped below the sleeve 27 without releasing the set packer, the tubing T is lowered until the collar 71 engages the top of collar 74*b*. Downwardly directed forces are then exerted against tubing string T to sever the pin 72 which permits the collar 71 to move axially upwardly to expose the split ring 73. The downward movement of mandrel 70 permitted by upward movement of the collar 72 permits the split ring teeth 73*a* to ratchet downwardly over the teeth 74*a*. Once engaged, reverse movement between the teeth in the two members is prohibited because of the tooth design. The enlarged heads 74*d* which are maintained coincident with the recess 70*b* as the tubing string is raised are biased resiliently inwardly into the recess to permit the retrieving mechanism to be extracted from the packer mandrel 13. By this means, it will be appreciated that the retrieving means R may be withdrawn from the set packer without releasing the packer.

A modified form of the packer of the present invention is indicated generally at 110 in FIG. 4. The packer apparatus 110 is similar to the packer apparatus 10 except that a modified setting mechanism S-1 is formed as an integral part of a packer portion P-1 and is not removable as is the setting mechanism S employed with the packer portion P of FIGS. 1–3. In FIG. 4, the various components in the apparatus 110 have been identified with reference characters which are 100 higher than corresponding components in the apparatus 10 and it will be appreciated that the operation and construction of related components in both forms are substantially similar.

The setting portion S-1 of the apparatus 110 is equipped with an hydraulically expandable chamber 140 supplied with fluid pressure through a radial bore 141 communicating with the internal opening in a tubular setting mandrel 142. Fluid flowing from the bore 141 is confined between upper and lower axially spaced resilient O-ring seals 180 and 181 respectively and flows through a radial bore 113*k* extending through the packer mandrel 113.

The upper axial end of the chamber 140 is formed by the lower wedging member 122 which is equipped with annular O-ring seals 182 to form a sliding seal with the external surface of mandrel section 113*b.* The lower end of chamber 140 is formed by an annular piston 183 equipped with internal and external annular O-ring seals adapted to form sliding seals with the mandrel section 113*b* and a surrounding sleeve 184 which provides the outer chamber wall. The sleeve 184 is threadedly engaged to the lower wedging component 122. Confined below the piston 183 and within the sleeve 184 is a locking ring 185 which is equipped with an internally tapered conical bearing surface adapted to bear against an externally tapered surface formed on a wedging member 186.

In setting the packer P-1, the ball B is dropped into the tubing string T and seated over the sleeve 160. Hydraulic pressure supplied through the ubing string T and through the central bore of the setting mandrel 142 is communicated through the radial bores 141 and 113*k* into the chamber 140. This pressure is exerted against the axially movable annular piston 183 and the wedging member 122 tending to drive the two components apart. When a sufficient force has been exerted, the upwardly directed force on the lower wedging member 122 and attached sleeve 184 serves a shear pin 187 which permits the sleeve 184 to be moved axially upwardly with respect to the packer mandrel 113*b.* Upward movement of the wedging means 122 forces the slips 111 radially outwardly into anchoring engagement with the surrounding well conduit C. Continued pressure tends to drive the piston 183, locking ring 185 and wedging member 16 downwardly. This movement is transmitted through the dogs 125 to the packer mandrel 113 which in turn transmits the motion to the upper wedging member 123. When sufficient forces develop, the shear pin 121 severs which permits the upper bearing assembly 115 to be moved downwardly with respect to the stationary spreader member 123 to compress and radially expand the packer 112. When the setting pressure is released, the one-way action of the locking ring 185 stops reverse movement of the components to prevent release of the slips and seal.

Figure 5A:
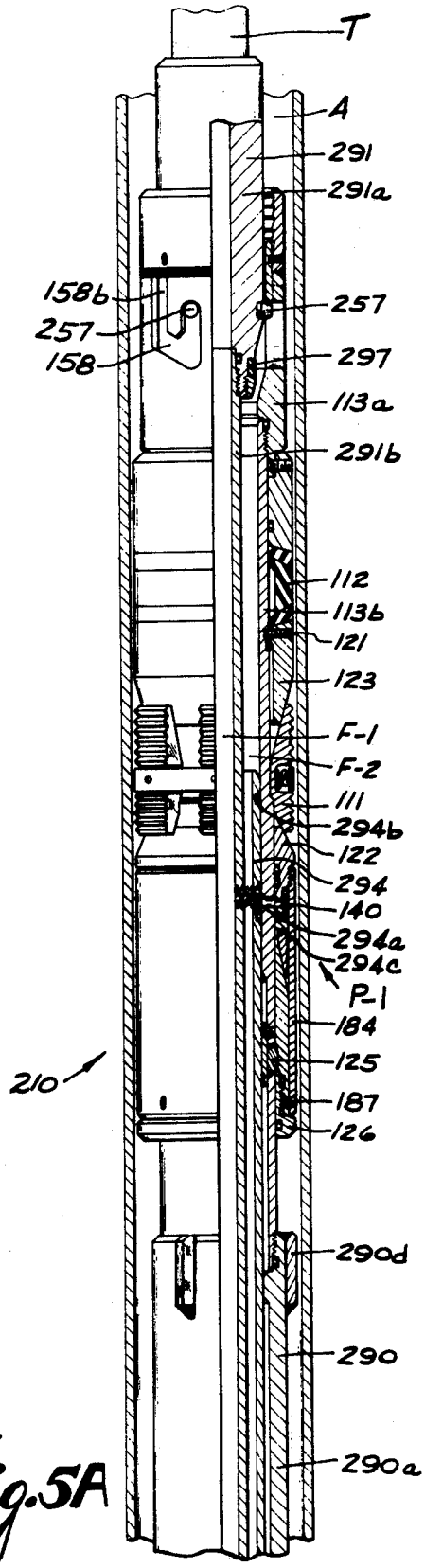
FIGS. 5A and 5B are elevations in quarter section illustrating the upper and lower portions respectively of an unset well packer such as the packer illustrated in FIG. 4 equipped with a gravel pack apparatus of the present invention.
Figure 6A:
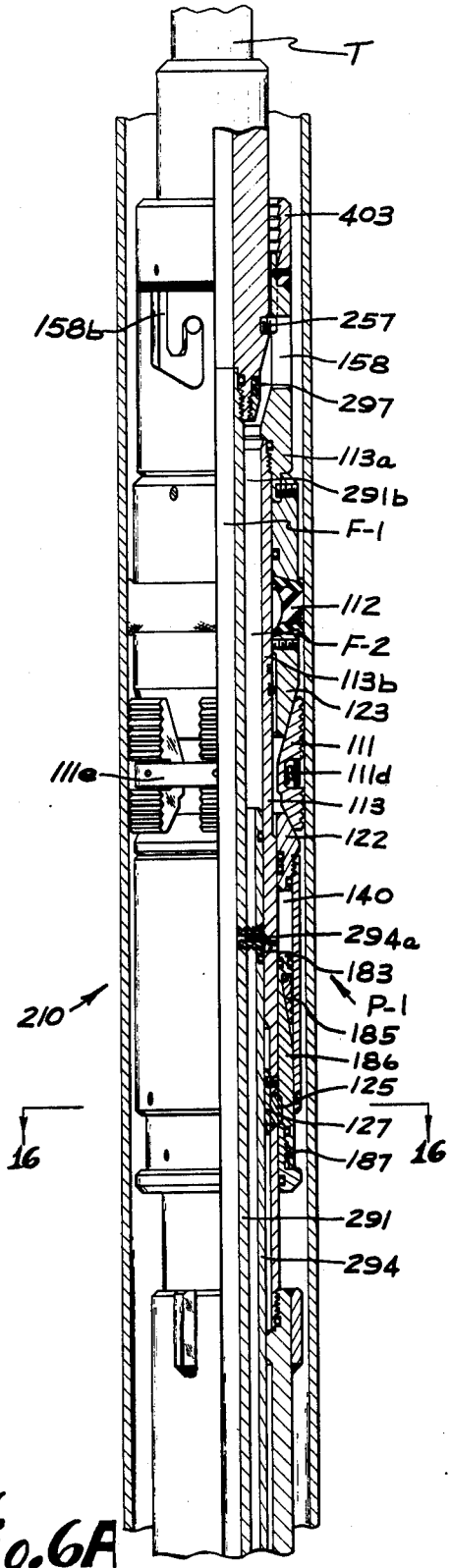
FIGS. 6A and 6B illustrate the apparatus of FIGS. 5A and 5B in set position.

Once the packer portion P-1 has been set, the setting mandrel 142 may be removed by suitable manipulation of the tubing string T to move pins 157 extending from the mandrel 142 through release paths 158*b* in J-slots 158 formed in mandrel 113*a.* The configuration of J-slots 158 may be seen in FIGS. 5A and 6A.

FIGS. 5A, 5B, 6A, 6B, 7A, 7B, 8, 9, 17A, 17B, 18A and 18B illustrate a retrievable well packer and gravel pack apparatus employing a packer P-1 of the type illustrated in FIG. 4 having an integrally formed, nonremovable setting mechanism S-1. FIGS. 10, 11 and 12 illustrate a retrievable well packer and gravel pack apparatus employing a packer P of the type having a removable setting mechanism.

Figure 5B:
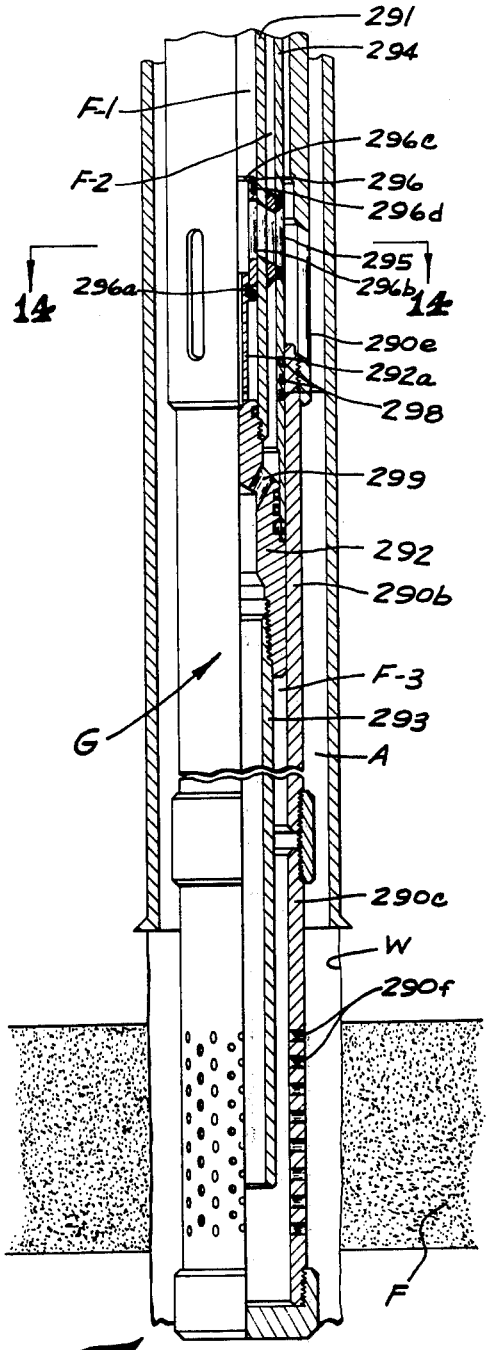

Referring to FIGS. 5A and 5B, the retrievable well packer and gravel pack apparatus of the present invention is indicated generally at 210. In the modification of FIGS. 5A and 5B, the gravel pack equipment extending through the packer is indicated generally at G. The gravel pack cooperates with a composite tubular sleeve 290 having an upper section 290*a* threadedly engaged to a central section 290*b* which in turn is threadedly engaged with a ported gravel screen 290*c.* The upper external end of the sleeve 290 is equipped with radially projecting centralizing fins 290*d.* The section 290*a* is equipped with radial ports 290*e* and the screen is provided with ports 290*f.* The apparatus 210 is designed to be run as a unit on a tubing string T with which it is lowered to the bottom of the well where the packer P-1 is set and the gravel pack portion G is employed to deposit gravel in the well bore W between the screen 290*c* and the surrounding formation F. After formation of the desired gravel pack screen, the gravel pack portion G is removed from the set packer and retrieved to the surface so that a production string T-1 (FIGS. 18A and 18B) may be secured to the packer to produce filtered petroleum fluids through the screen 290*c.*

The gravel pack portion G is adapted to circulate fluids along several different flow passages which may be opened or closed by suitable manipulation of the tubing string T. The main body of the gravel pack is provided by a tubular mandrel 291 which extends axially internally of the packer mandrel 113. The mandrel 291 includes an attachment head 291*a* which is employed to secure the gravel pack to the tubing string and is equipped with radially projecting pins 257 extending into the J-slots 158. The head 291*a* is threadedly engaged to a central sleeve 291*b* threadably connected at its lower end to a ported connecting member 292 which in turn is threadedly engaged at its lower end to a bottom sleeve 293. A second, larger diameter sleeve 294 extends about and is radially spaced from the inner sleeve 291 along a portion of its length. The sleeve 294 is removably carried internally of the packer P1 and is adapted to be withdrawn from the packer along with the remaining gravel pack components following completion of the gravel operation. A radial conduit 294*a* extends from the central opening in the sleeve 291*b* and opens externally of the sleeve 294 between upper and lower annular O-ring seals 294*b* and 294*c* respectively, to provide pressurizing fluid to expansion chamber 140. The lower end of the sleeve 294 is pinned to member 292 and resilient O-ring seals are employed between the two components to provide a leakproof engagement.

Figure 14:
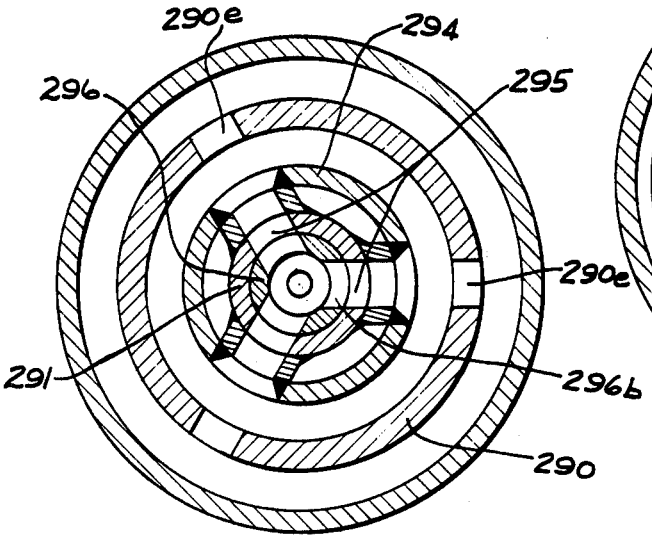
FIG. 14 is an enlarged cross-sectional view taken along the line 14—14 of FIG. 5B.

Three separate crossover flow passages 295 extend radially from the mandrel 291 and open externally of the sleeve 294 as best illustrated by joint reference to FIGS. 5B and 14. An hydraulically actuated, movable setting sleeve 296 is temporarily secured to an upper sleeve portion 292*a* of the connection member 292 by shear pins 296*a.* Radial openings 296*b* extend through the sleeve 296 to permit fluid contained within the bore of mandrel 291 to communicate with the crossover flow passages 295. The upper end of sleeve 296 is equipped with a seating surface 296*c* and an annular O-ring seal 296*d.* As will be seen, these latter two components cooperate with a metal ball to provide a seal during the setting of packer P-1.

Where required in the gravel pack G, suitable O-ring seals are interposed between threadedly engaged members to ensure leakproof connections. An annular resilient valving seal 297 is carried adjacent the lower end of head 291*a* and is adapted to be moved axially into and out of engagement with the internal bore of packer mandrel 113*b* to open and close a fluid flow passage as will be explained. A group of three annular O-ring seals 298 carried about the external surface adjacent the lower end of sleeve 294 are adapted to move into and out of engagement with the internal cylindrical surface of tubular section 290*b* to provide valving connections for another flow passage. Ports 299 extend through the connecting member 292 to provide fluid communication between the internal portion of sleeve 293 and the annular space included between mandrel 291 and sleeve 294 to complete a flow passage extending through the bottom of the sleeve 293.

Figure 6B:
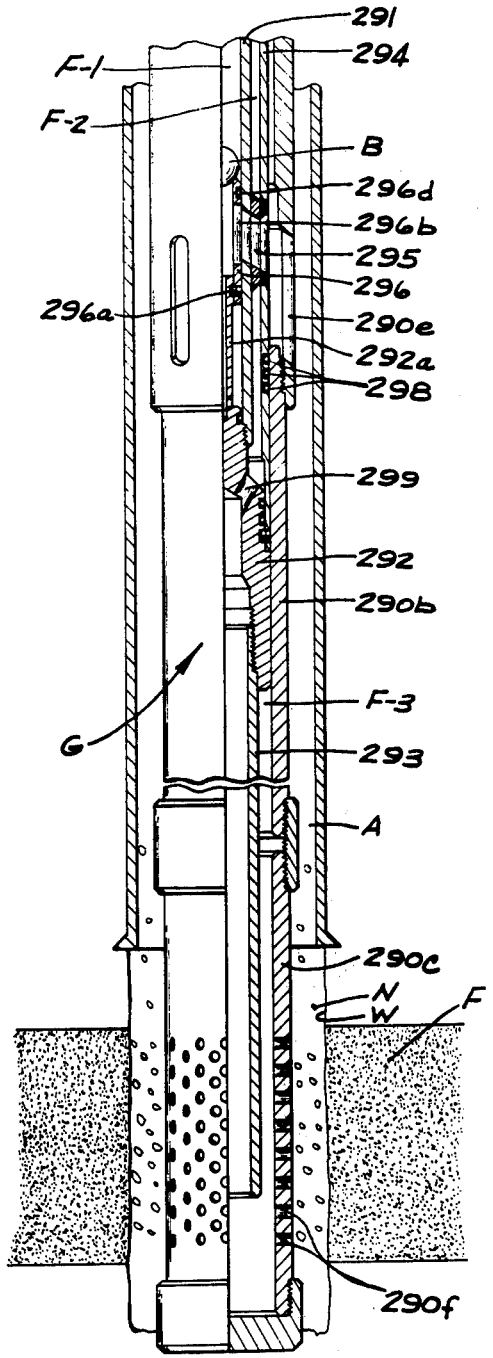
Figures 17A, 17B, 18A, 18B:
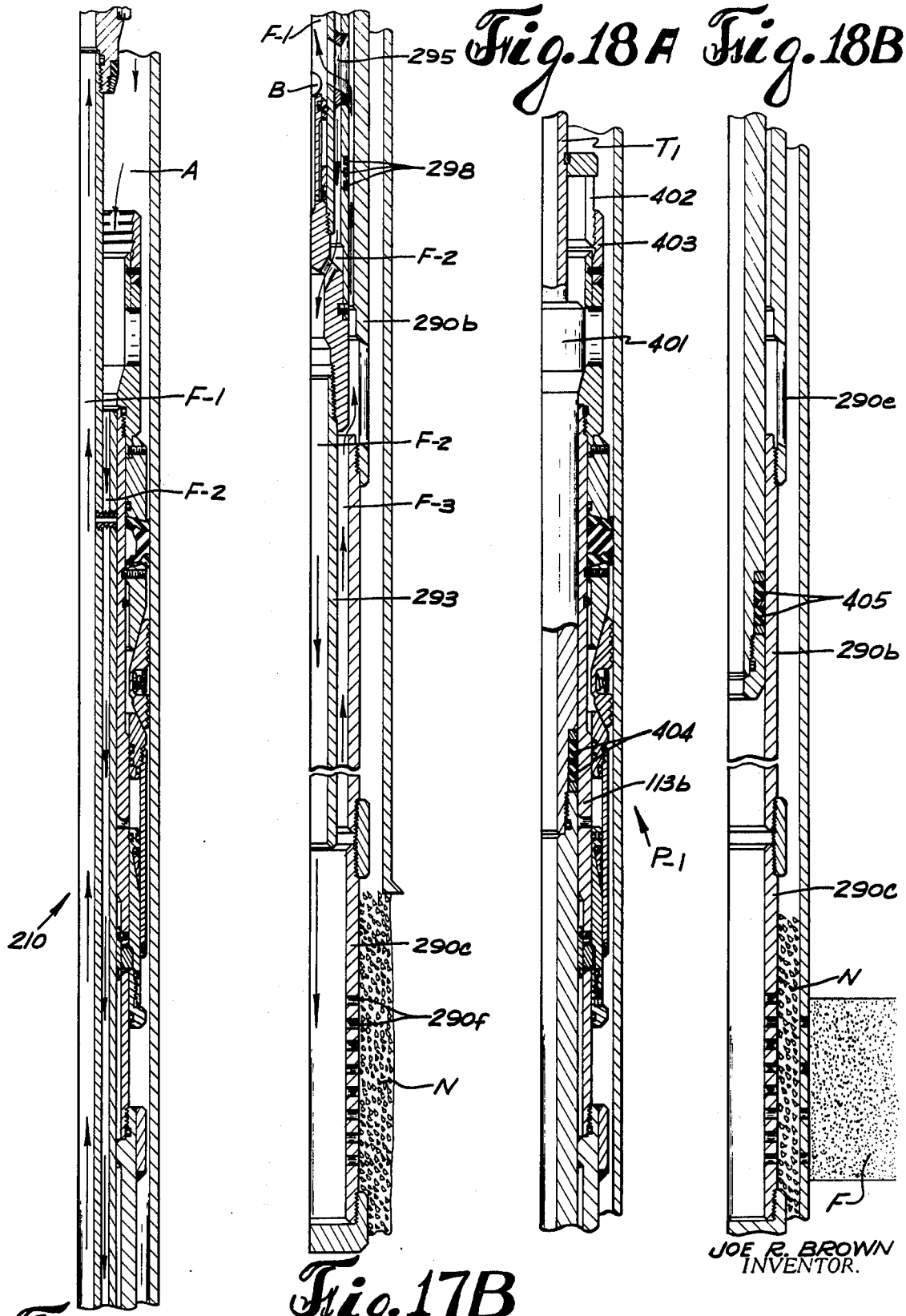
FIGS. 17A and 17B are upper and lower quarter-sectional elevations, respectively, of the gravel pack apparatus and packer illustrated in FIGS. 5A and 5B as they appear when employed for removing debris from the internal portions of the screen employed in the gravel packing operation.
FIGS. 18A and 18B are upper and lower quarter-sectional elevation illustrating the packer of FIGS. 17A and 17B being employed to produce well fluids.

The described construction of the gravel pack G when in position within the packer P-1 forms three separate flow paths indicated at F-1, F-2 and F-3. The flow path F-1 is in communication with the bore of tubing string T and extends through the center of gravel pack mandrel 291 to the crossover passage 295 and into the annular area A between the gravel pack screen 290*c* and in the surrounding well bore W. Flow passage F-2 beings in the annular area A above the packer seal 112 and extends through the annular space included between the gravel pack mandrel 291 and the surrounding packer mandrel 113*b* to the annular space between the gravel pack mandrel 291 and the sleeve 294 to the bore openings 299 formed in connection member 292 and into the internal portions of the sleeve 293. The third flow path F-3 is formed in the annular space within the surrounding sleeve 290 and the inner wall structure formed by sleeve 293 and connection member 292. Flow passage F-1 is closed to fluid flow introduced through the tubing string T when a ball is seated on the setting sleeve 296 as illustrated in FIG. 6B before the sleeve is driven downwardly. Fluid flow through passage F-2 is prevented when the annular seal ring 297 is in sealing engagement with the internal walls of packer mandrel section 113*b* as illustrated in FIG. 7A. Fluid flow through passage F-3 is permitted when the seal rings 298 are raised axially above the internal cylindrical wall portion of sleeve 290*b* as illustrated in FIG. 17B. When open, passage F-3 permits fluid flow between passages F-1 and F-2 along a flow passage which remains within the sleeve 290.

The operation of the retrievable well packer and gravel pack apparatus 210 will now be described. The apparatus is lowered into the well conduit C with packer slips 111 and seal 112 radially retracted as illustrated in FIG. 5A. When the desired subsurface location is reached, the ball B is dropped through the tubing string T and seated on the setting sleeve 296 as illustrated in FIG. 6B. Fluid pressure is then introduced into the tubing string T and communicated through the radial conduit 294*a* to the packer expansion chamber 140. Expansion of the chamber 140 sets the slips 111 and packer seal 112 in the manner previously described with reference to FIG. 4. When sufficient hydraulic pressure has been developed, following the setting of the packer P-1, the shear pins 296*a* sever to permit the sleeve 296 to move axially downwardly to open the crossover flow passages 295 as illustrated in FIG. 7B.

When the components are in the relative positions illustrated in FIGS. 7A and 7B with the tubing string T lowered to close flow passage F-2 by moving the annular seal 297 into sealing engagement with the packer mandrel 113*b,* setting of the packer seal 112 may be tested with pressure exerted below the seal. Thus, the fluid pressure introduced through flow passage F-1 exits into the annular area A below the set seal and is exerted against the base of the seal 112. An increase in pressure in the annulus at the wellhead indicates leakage past the seal.

The graveling operation is conducted with the apparatus in the position illustrated in FIGS. 7A and 7B except that the tubing string T is elevated to remove seal 297 from contact with mandrel 113*b* whereby fluid flow passage F-2 is open to provie a return flow path for fluid circulated through the apparatus from the tubing string T. In the latter position, fluid containing small pieces of gravel N or other suitable material is introduced into the gravel pack G through the tubing string T and flows through the flow passage F-1 into the crossover passages 295 and down through the annular area A below the seal 112. The small gravel particles N are deposited between the screen 290*c* and the bore wall W. The fluid carrying the particles N filters in through the screen openings 290*f* and enters the bottom of sleeve 293 where it travels upwardly through ports 299 into flow passage F-2 and up into the annular area A above the set seal 112 where it is circulated to the surface.

FIGS. 17A and 17B illustrate the apparatus 210 in position for removing debris contained within the screen 290*c.* This is effected by raising the tubing string T until the seals 298 are out of sealing engagement with the sleeve portion 290*b* to open flow passage F-3. Cleansing fluid is then introduced into the well through the annulus A above the set seal 112 where it flows downwardly through flow passage F-2, exits through the bottom of sleeve 293 and returns upwardly through the passage F-3 carrying with it debris picked up from within the sleeve 290*c.* From the passage F-3, the fluid and collected debris flow into the crossover passage 295 and up to the well surface through the flow passage at F-1.

Following completion of the graveling or other operation of the apparatus 210, the gravel pack portion G may be removed from the set packer by lowering the tubing string, rotating it and raising it so that the pins 257 are moved through the J-slots 158 into the release slots 158*b.* Retrieval of the set packer and attached screen is illustrated in FIGS. 8 and 9 and is similar to the procedure described with respect to the retrieval of the packer illustrated in FIG. 4.

FIGS. 10 and 11 illustrate a modified retrievable well packer and gravel pack apparatus indicated generally at 310. The packer portion P of the apparatus 310 is similar to that previoiusly described with reference to FIGS.

5A and 5B. A primary distinction in operation is that the setting mechanism S is withdrawn from the set packer P along with the gravel pack G when graveling operations have been completed.

FIGS. 18A and 18B illustrate the packer P-1 and screen 290c illustrated in FIGS. 5A and 5B in position in the well conduit C with a stinger 401 set within the packer for production purposes. The stinger is maintained in position by engagment of locking teeth on collet fingers 402 with internally formed teeth on an upper collar 403 carried on the set packer P-1. Upper seals 404 carried on the outer body of the stinger 401 provide a pressureproof seal along the internal walls of mandrel section 113b. A lower set of nonexpanding seals 405 provide a seal with the internal walls of the sleeve member 290b. The stinger 401 thus forms a leakproof seal between the screen 290c and the packer mandrel 113 so that fluids in the formation F are constrained to move through the stinger 401 and into a production tubing T-1. As used herein, the term "nonexpanding seals" is intended to include any self-actuated sealing means including metal-to-metal seals, O-ring seals and other self-actuated seals. The term is also intended to distinguish over radially expanding seals such as the resilient packer seals 12 and 112 which are actuated to expand radially during the packer setting procedure.

While graveling and circulating operations have been described, it will be readily appreciated that the apparatus of the present invention may be employed for other purposes such as acidizing or other purposes. The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. Anchoring means for anchoring well equipment in a well conduit comprising:
   a. supporting body;
   b. a plurality of radially movable, single piece slip means carried about said supporting body;
   c. friction creating means carried on the radially outer surfaces of said slip means for anchoring said slip means and said supporting body to said well conduit;
   d. first and second axially movable wedging means carried on said supporting body and adapted to be moved axially for controlling radial movement of said slip means; and
   e. connecting means linking said first and second wedging means with said slip means for producing a first radial movement in said slip means by axial movement of said first wedging means over a given distance and a second smaller radial movement of said slip means by axial movement of said second wedging means over the same distance.

2. An anchoring means as defined in claim 1 wherein:
   a. said connecting means include bearing faces on said wedging means and said slip means adapted to slide against each other for controlling radial movement of said slip means; and
   b. the effective bearing face angle of inclination between said slip means and said first wedging means is steeper than the effective bearing face angle of inclination between said slip means and said second wedging means whereby axial movement of said first wedging means over a given distance produces greater radial movement of said slip means than axial movement of said second wedging means over the same distance.

3. An anchoring means as defined in claim 2 wherein:
   a. said friction creating means is carried at first and second locations on said slip means; and
   b. a major portion of the total friction producing means is carried at said second axial location on said slip means.

4. An anchoring means as defined in claim 3 further including release means for moving said second wedging means in a direction permitting radial retraction of said slip means while said first wedging means remains substantially fixed axially with respect to said well conduit.

5. An anchoring means as defined in claim 4 further including driving means carried on said supporting body and operable by said release means for moving said slip means axially relative to said first wedging means in a direction permitting radial retraction of said slip means while said first wedging means remains substantially fixed axially with respect to said well conduit.

6. An anchoring means as defined in claim 5 further including:
   a. an annular mounting body for securing said slip means about said supporting body;
   b. a plurality of radially extending slots formed between a central bore and an outer retaining band in said annular mounting body with said slip means extending axially beyond both axial ends of said annular mounting body and being movable radially through said slots;
   c. biasing means connecting between said annular mounting body and said slip means for biasing said slip means radially inwardly; and
   d. circumferentially extending slots formed along the outer surface of said slip means for receiving said outer retaining band to permit movement of said friction creating means radially beyond the outer radial boundary of said annular mounting body.

7. An anchoring means as defined in claim 5 further including resilient seal means for radial movement into and out of pressure sealing engagement with said well conduit.

8. An anchoring means as defined in claim 7 further including:
   a. setting means responsive to a setting pressure for moving said first and second wedging means axially to thereby move said slip means radially into anchoring engagement with said well conduit;
   b. locking means included in said setting means for retaining said slip means in anchoring engagement with said well conduit following reduction in the setting pressure;
   c. mechanically actuated means included in said release means and responsive to upward axial motion induced from the well surface for moving said second wedging means axially upwardly with respect to said slip means; and
   d. engagement means carried by said driving means and responsive to upward axial motion induced from the well surface for engaging and moving said slip means axially upwardly with respect to said first wedging means following the upward movement of said second wedging means.

9. An anchoring means as defined in claim 8 wherein the effective angle of inclination between said first wedging means and said slip means is between 30° to 45°.

10. An anchoring means as defined in claim 9 further including:

a. an annular mounting body for securing said slip means about said supporting body;

b. a plurality of radially extending slots formed between a central bore and an outer retaining band in said annular mounting body with said slip means extending axially beyond both axial ends of said annular mounting body and being movable radially through said slots;

c. biasing means connected between said annular mounting body and said slip means for biasing said slip means radially inwardly; and d. circumferentially extending slots formed along the outer surface of said slip means for receiving said outer retaining band to permit movement of said friction creating means radially beyond the outer radial boundary of said annular mounting body.

11. Anchoring means as defined in claim 5 further including:

a. setting means responsive to a setting pressure for moving said first and second wedging means axially to thereby move said slip means radially into anchoring engagement with said well conduct;

b. locking means included in said setting means for retaining said slip means in anchoring engagement with said well conduit following reduction in the setting pressure;

c. latching means releasably connecting a tubing string to said supporting outer body; and d. pressure communicating means extending from a flow passage in said tubing string to said setting means for providing setting pressure from said tubing string to said setting means.

12. Anchoring means as defined in claim 11 wherein said latching means includes pin and slot engagement means whereby said setting means may be removed from said anchoring means by a predetermined sequence of rotational and axial movements of said tubing string.

13. An anchoring means as defined in claim 2 wherein the effective angle of inclination between said first wedging means and said slip means is between approximately 30° to 45°.

14. An anchoring means as defined in claim 1 wherein:

a. said friction creating means is carried at first and second locations on said slip means; and b. a major portion of the total friction producing means is carried at said second axial location on said slip means.

15. An anchoring means as defined in claim 1 further including release means for moving said second wedging means in a direction permitting radial retraction of said slip means while said first wedging means remains substantially fixed axially with respect to said well conduit.

16. An anchoring means as defined in claim 15 further including driving means carried on said supporting body and operable by said release means for moving said slip means axially relative to said first wedging means in a direction permitting radial retraction of said slip means while said first wedging means remains substantially fixed axially with respect to said well conduit.

17. An anchoring means as defined in claim 1 further including:

a. an annular mounting body for securing said slip means about said supporting body;

b. a plurality of radially extending slots formed between a central bore and an outer retaining band in said annular mounting body with said slip means extending axially beyond both axial ends of said annular mounting body and being movable radially through said slots;

c. biasing means connected between said annular mounting body and said slip means for biasing said slip means radially inwardly; and d. circumferentially extending slots formed along the outer surface of said slip means for receiving said outer retaining band to permit movement of said friction creating means radially beyond the outer radial boundary of said annular mounting body.

18. An anchoring means as defined in claim 1 further including resilient seal means for radial movement into and out of pressure sealing engagement with said well conduit.

19. Anchoring means as defined in claim 1 further including:

a. setting means responsive to a setting pressure for moving said first and second wedging means axially to thereby move said slip means radially into anchoring engagement with said well conduit;

b. locking means included in said setting means for retaining said slip means in anchoring engagement with said well conduit following reduction in the setting pressure;

c. latching means releasably connecting a tubing string to said supporting outer body; and d. pressure communicating means extending from a flow passage in said tubing string to said setting means for providing setting pressure from said tubing string to said setting means.

20. Anchoring means as defined in claim 19 wherein said setting means is removably connected with said anchoring means by said latching means whereby manipulation of said tubing string permits said setting means to be removed from said anchoring means.

21. Anchoring means as defined in claim 20 wherein said latching means includes pin and slot engagement means whereby said setting means may be removed from said anchoring means by a predetermined sequence of rotational and axial movements of said tubing string.

22. Anchoring means for anchoring well equipment in a well conduct comprising:

a. a supporting body;

b. a plurality of radially movable, single pieces slip means carried about said body;

c. friction creating means carried on the radially outer surfaces of said slip means for anchoring said slip means and said supporting body to said well conduit;

d. first and second axially movable wedging means carried on said supporting body and adapted to be moved axially for controlling radial movement of said slip means;

e. an annular mounting body for securing said slip means about said supporting body;

f. a plurality of radially extending slots formed between a central bore and outer retaining band portions in said annular mounting body with said slip means extending axially beyond both axial ends of said annular mounting body and being movable radially through said slots;

g. biasing means connected between said annular mounting body and said slip means for biasing said slip means radially inwardly; and h. circumferentially extending slots formed along the outer surface of said slip means receiving said outer retaining band to portions to permit movement of said friction creating means radially beyond the outer radial boundary of said annular mounting body.

23. An anchoring means as defined in claim 22 wherein:

a. said friction creating means includes a plurality of axially spaced, circumferentially extending teeth formed along the outer radial surface of said slip means; and b. said biasing means include spring means disposed between said slip means and said outer retaining band portions.

24. An anchoring means as defined in claim 23 further including:

a. resilient seal means for radial movement into and out of pressure sealing engagement with said well conduit;

b. setting means responsive to pressure in said well conduit for moving said first and second wedging means axially to thereby move said slip means radially into anchoring engagement with said well conduit; and c. locking means included in said setting means for retaining said slip means in anchoring engagement with said well conduit following reduction in the setting pressure in said conduit.

25. An anchoring means as defined in claim 24 further including connecting means linking said first and second wedging means with said slip means for producing a first radial movement in said slip means by axial movement of said first wedging means over a given distance and a second smaller radial movement of said slip means by axial movement of said second wedging means over the same distance.

26. A well apparatus for use in a well conduit comprising:

a. a supporting outer body;

b. packing means carried on said supporting body;

c. anchoring means included with said packing means for anchoring said supporting body to a surrounding well conduit;

d. primary seal means included in said packing means for forming a pressure seal between said conduit and said supporting body;

e. first and second axially extending flow passages formed within said supporting body for conducting fluids between upper and lower axial points above and below said primary seal means wherein at least a portion of said first and second flow passages extend through an axially extending inner body which is removably carried within said supporting outer body and wherein said inner body includes upper attaching means for attaching said inner body with a tubing string and wherein said inner body is separably engaged with said outer body by releasable latching means operable by said tubing string for removing said inner body from said outer body;

f. crossover flow passage means communicating said first flow passage with the area externally of said supporting body at a point below said primary seal means and above the lower end of said second flow passage;

g. first valve means connected with said first flow passage for opening said crossover flow passage to permit fluid flow between said first flow passage and points externally of said supporting body;

h. second valve means connected with said second flow passage for closing and opening said second flow passage to fluid flows;

i. a plurality of radially movable, single piece slip means carried about said supporting body;

j. friction creating means carried on the radially outer surfaces of said slip means for anchoring said slip means and said supporting body to said well conduit;

k. first and second axially movable wedging means carried on said supporting body and adapted to be moved axially for controlling radial movement of said slip means; and l. connecting means linking said first and second wedging means with said slip means for producing a first radial movement in said slip means by axial movement of said first wedging means over a given distance and a second smaller radial movement of said slip means by axial movement of said second wedging means over the same distance.

27. A well apparatus as defined in claim 26 wherein:

a. said connecting means include bearing faces on said wedging means and said slip means adapted to slide against each other for controlling radial movement of said slip means; and b. the effective bearing face angle of inclination between said slip means and said first wedging means is steeper than the effective bearing face angle of inclination between said slip means and said second wedging means whereby axial movement of said first wedging means over a given distance produces greater radial movement of said slip means than axial movement of said second wedging means over the same distance.

28. A well apparatus as defined in claim 27 further including release means for moving said second wedging means in a direction permitting radial retraction of said slip means while said first wedging means remains substantially fixed axially with respect to said well conduit.

29. A well apparatus as defined in claim 26 further including:

a. an annular mounting body for securing said slip means about said supporting body;

b. a plurality of radially extending slots formed between a central bore and outer retaining band portions in said annular mounting body with said slip means extending axially beyond both axial ends of said annular mounting body and being movable radially through said slots;

c. biasing means connected between said annular mounting body and said slip means for biasing said slip means radially inwardly; and d. circumferentially extending slots formed along the outer surface of said slip means for receiving said outer retaining band portion to permit movement of said friction creating means radially beyond the outer radial boundary of said annular mounting body.

30. A method of gravel packing a well comprising the steps of:

a. running a production well packer and gravel pack means on a pipe string through a surrounding conduit in the bore of said well;

b. hydraulically anchoring said well packer in sealing engagement with said surrounding conduit;

c. circulating particulate laden fluid through said pipe string, through a first flow path in said gravel pack means, into the area surrounding said gravel pack means below said well packer where at least some of said particulate is deposited, and through a second flow path in said gravel pack means and the annular area surrounding said pipe string above said well packer to the surface of said well;

d. circulating cleansing fluid through said annular area surrounding said pipe string, through said well packer and gravel pack means, and through said pipe string to the surface of said well without traversing said particulate deposited in said area surrounding said gravel pack means below said well packer;

e. removing said pipe string and said gravel pack means from said anchored packer; and f. running a production string into said well and forming a fluid-tight sealing engagement with said anchored well packer.

31. A method of gravel packing a well as set forth in claim 30, characterized in that prior to said circulation of cleansing fluid, said pipe string is manipulated to open valve means by which a third flow path is opened through said well packer and gravel pack means for circulation of said cleansing fluid.

32. A method of gravel packing a well as set forth in claim 31 in which said valve means comprises cooperative seal and seat means on said well packer and gravel pack means.

33. A method of gravel packing a well comprising the steps of:

a. running a production well packer and gravel pack means on a pipe string through a surrounding conduit in the bore of said well;

b. hydraulically anchoring said well packer in sealing engagement with said surrounding conduit by supplying a first pressure to said packer through said pipe string, a second and higher pressure being supplied through said pipe string after said anchoring to open valve means in said gravel pack means to permit circulation through a first flow path in said gravel pack means;

c. circulating particulate laden fluid through said pipe string, through said first flow path in said gravel pack means, into the area surrounding said gravel pack means below said well packer where at least some of said particulate is deposited, and through a second flow path in said gravel pack means and the annular area surrounding said pipe string above said well packer to the surface of said well;

d. removing said pipe string and said gravel pack means from said anchored packer; and e. running a production string into said well and forming a fluid-tight sealing engagement with said anchored packer.

34. A method of gravel packing a well comprising the steps of:

a. running a production well packer and gravel pack means on a pipe string through a surrounding conduit in the bore of said well;

b. hydraulically anchoring said well packer in sealing engagement with said surrounding conduit;

c. testing the sealing engagement of said well packer by exerting pressure below said seal through said pipe string and gravel pack means;

d. circulating particulate laden fluid through said pipe string, through a first flow path in said gravel pack means, into the area surrounding said gravel pack means below said well packer where at least some of said particulate is deposited, and through a second flow path in said gravel pack means and the annular area surrounding said pipe string above said well packer to the surface of said well;

e. removing said pipe string and said gravel pack means from said anchored packer; and f. running a production string into said well and forming a fluid-tight sealing engagement with said anchored well packer.

35. A method of gravel packing a well comprising the steps of:

a. running a production well packer and gravel pack means on a pipe string through a surrounding conduit in the bore of said well;

b, hydraulically anchoring said well packer in sealing engagement with said surrounding conduit;

c. circulating particulate laden fluid through said pipe string, through a first flow path in said gravel pack means, into the area surrounding said gravel pack means below said well packer where at least some of said particulate is deposited, and through a second flow path in said gravel pack means and the annular area surrounding said pipe string above said well packer to the surface of said well;

d. removing said pipe string and said gravel pack means from said anchored packer;

e. running a production string into said well and forming a fluid-tight sealing engagement with said anchored well packer;

f, removing said production string from said well;

g. running a retrieving tool into said well for engagement with said well packer;

h. pulling upwardly on said retrieving tool to release said well packer from said anchoring; and i. removing said well packer from said well.

36. A method of gravel packing a well comprising the steps of:

a. running a well packer and gravel pack means on a pipe string through a surrounding conduit in the bore of said well;

b. applying pressure to said well packer through said pipe string to anchor said packer in sealing engagement with said surrounding conduit;

c. applying further pressure through said pipe string to open first valve means and a first flow path in said gravel pack means through which pressure may be applied below said well packer for testing said sealing engagement;

d. opening second valve means and a second flow path in said gravel pack means, e. circulating particulate laden fluid through said pipe string, through said first flow path in said gravel pack means, into the area surrounding said well packer below its sealing engagement with said conduit where at least some of said particulate is deposited, and through said second flow path in said gravel pack means and the annular area surrounding said pipe string above said well packer to the surface of said well;

f. opening third valve means and a third flow path in said gravel pack means;

g. circulating cleansing fluid through said annular area surrounding said pipe string, through said second and third flow paths in said well packer and gravel pack means, and through said pipe string to the surface of said well;

h. removing said pipe string and said gravel pack means; and i, running a production string into said well and forming a fluid-tight sealing engagement with said well packer.

37. A well apparatus for use in a well conduit comprising:

a. a supporting outer body;

b. packing means carried on said supporting body;

c. anchoring means included with said packing means for anchoring said supporting body to a surrounding well conduit;

d. primary seal means included in said packing means for forming a pressure seal between said conduit and said supporting body;

e. first and second axially extending flow passages formed within said supporting body for conducting fluids between upper and lower axial points above and below said primary seal means;

f. crossover flow passage means communicating said first flow passage with the area externally of said supporting body at a point below said primary seal means and above the lower end of said second flow passage;

g. first valve means connected with said first flow passage for opening said crossover flow passage to permit fluid flow between said first flow passage and points externally of said supporting body;

h. second valve means connected with said second flow passage for closing and opening said second flow passage to fluid flow;

i. a plurality of radially movable, single piece slip means carried about said supporting body;

j. friction creating means carried on the radially outer surfaces of said slip means for anchoring said slip means and said supporting body to said well conduit;

k. first and second axially movable wedging means carried on said supporting body and adapted to be moved axially for controlling radial movement of said slip means;

l. setting means responsive to a setting pressure for moving said first and second wedging means axially to thereby move said slip means radially into anchoring engagement with said well conduit;

m. locking means included in said setting means for retaining said slip means in anchoring engagement with said well conduit following reduction in the setting pressure;

n. latching means releasably connecting a tubing string to said supporting outer body; and o. pressure communicating means extending from a flow passage in said tubing string to said setting means for providing setting pressure from said tubing string to said setting means.

38. A method of treating a well for production which includes lowering an operating tool string having connected thereto a packer having a screen supported therebelow into the well bore; seating the packer in sealing position in the well bore above a producing formation therein with the screen in communication with the producing formation; opening a flow path for circulation downwardly past the packer and the screen to the producing formation and upwardly past the screen and the packer to the well surface for treating the well formation; introducing gravel through said circulation flow path into the well bore below the packer exteriorly of the screen to form a gravel pack filling the annular space between the screen and the well bore to a point above the screen; introducing fluids under pressure into the well producing formation through the packer and screen, and thereafter removing the operating tool string from the well bore; and establishing a production flow course from the packer to the well surface for conducting well fluids entering said flow course from the producing formation through the gravel pack and screen.

39. A method of treating a well for production which includes lowering an operating tool string having connected thereto a packer having a screen supported therebelow into the well bore; seating the packer in sealing position in the well bore above a producing formation therein with the screen in communication with the producing formation; opening a flow path for circulation downwardly past the packer and the screen to the producing formation and upwardly past the screen and the packer to the well surface for treating the well formation; introducing gravel through said circulation flow path into the well bore below the packer exteriorly of the screen to form a gravel pack filling the annular space between the screen and the well bore to a point above the screen; circulating fluid through the operating tool string in a reverse direction in a path which does not traverse the gravel pack to remove excess gravel from the operating tool string after the annular space has been filled to a point above the screen; removing the operating tool string from the well bore; and establishing a production flow course from the packer to the well surface for conducting well fluids entering said flow course from the producing formation through the gravel pack and screen.

40. A method of treating a well for production which includes lowering an operating tool string having connected thereto a packer having a screen supported therebelow into the well bore; seating the packer in sealing position in the well bore above a producing formation therein with the screen in communication with the producing formation; opening a flow path for circulation downwardly past the packer and the screen to the producing formation and upwardly past the screen and the packer to the well surface for treating the well formation; introducing gravel through said circulation flow path into the well bore below the packer exteriorly of the screen to form a gravel pack filling the annular space between the screen and the well bore to a point above the screen; removing the operating tool string from the well bore; establishing a production flow course from the packer to the well surface for conducting well fluids entering said flow course from the producing formation through the gravel pack and screen; and reconnecting the operating tool string to the packer for reestablishing a flow path past the packer and screen to the producing formation for additional treatment of said formation.

41. An operating tool for setting a packer and screen in place in a well and establishing a circulation path through the packer and screen in place including: means for connecting said operating tool to said packer for setting the same in the well; means for establishing a flow path through the set packer and screen to the exterior of the screen; means for establishing a circulation path through the packer and the screen downwardly from the surface and upwardly to return to the surface; means for closing off the circulation path; and means for opening the circulation path by movement of an operating string connected to the operating tool.

42. An operating tool of the character set forth in claim 41 wherein said means for connecting said operating tool to said packer includes means releasably reconnectable with said packer.

43. A method of treating a well for production which includes lowering an operating tool string having connected thereto a packer having a screen supported therebelow into the well bore; seating the packer in sealing position in the well bore above a producing formation therein with the screen in communication with the producing formation; establishing a flow path for circulation downwardly past the packer and the screen to the producing formation and upwardly past the screen and the packer to the well surface for treating the well formation; introducing fluid under pressure into the well through the packer and screen while maintaining said flow path for circulation closed to prevent the return flow of such fluids upwardly past the screen and packer to the well surface; introducing gravel through said circulation flow path into the well bore below the packer exteriorly of the screen to form a gravel pack filling the annular space between the screen and the well bore to a point above the screen; removing the operating tool string from the well bore; and establishing a production flow course from the packer to the well surface for conducting well fluids entering said flow source from the producing formation through the gravel pack and screen.

* * * * *

UNITED STATES PATENT AND TRADEMARK OFFICE

CERTIFICATE OF CORRECTION

PATENT NO. : 4,049,055

DATED : September 20, 1977

INVENTOR(S) : Joe R. Brown

It is certified that error appears in the above-identified patent and that said Letters Patent are hereby corrected as shown below:

In Column 1, line 47, delete "and" and insert therefor --are--.

In Column 6, line 58, delete "process" and insert therefor --presence--.

In Column 9, line 13, delete "The", first occurence, and insert therefor --When the--.

In Column 11, line 61, delete "16" and insert therefor --186--.

In Column 11, line 46, delete "ubing" and insert therefor --tubing--.

In Column 12, line 61, delete "gravel" and insert therefor --graveling--.

In Column 13, line 41, delete "beings" and insert therefor --begins--.

UNITED STATES PATENT AND TRADEMARK OFFICE

CERTIFICATE OF CORRECTION

PATENT NO. : 4,049,055

DATED : September 20, 1977

INVENTOR(S) : Joe R. Brown

It is certified that error appears in the above-identified patent and that said Letters Patent are hereby corrected as shown below:

In Column 17, line 26, delete "conduct" and insert therefor --conduit--.

In Column 20, line 60, delete "portion" and insert therefor --portions--.

In Column 26, line 1, delete "fluid" and insert therefor --fluids--.

Signed and Sealed this

Second Day of May 1978

[SEAL]

Attest:

RUTH C. MASON
Attesting Officer

LUTRELLE F. PARKER
Acting Commissioner of Patents and Trademarks